United States Patent [19]

Khandros et al.

[11] 4,424,853

[45] Jan. 10, 1984

[54] FOUNDRY PRACTICES

[75] Inventors: Igor Y. Khandros, Hoboken; Bruce A. Heyer, Mahwah, both of N.J.

[73] Assignee: Abex Corporation, New York, N.Y.

[21] Appl. No.: 455,985

[22] Filed: Jan. 6, 1983

Related U.S. Application Data

[63] Continuation of Ser. No. 230,614, Feb. 2, 1981, abandoned.

[51] Int. Cl.[3] ..... B22D 1/00

[52] U.S. Cl. ..... 164/57.1; 164/66.1

[58] Field of Search ..... 164/55.1, 56.1, 57.1, 164/58.1, 66.1, 335, 336, 337; 75/53, 129

[56] References Cited

U.S. PATENT DOCUMENTS 2,871,533 2/1959 Swainson ..... 164/337 X

FOREIGN PATENT DOCUMENTS 2608282 9/1977 Fed. Rep. of Germany ..... 164/55.1

55-70462 5/1980 Japan ..... 164/66.1

753536 8/1980 U.S.S.R. ..... 164/55.1

*Primary Examiner*—Kuang Y. Lin

*Attorney, Agent, or Firm*—Kinzer, Plyer, Dorn & McEachran

[57] ABSTRACT

A base metal or alloy in the molten state is further alloyed with readily oxidizable elements in an alloying chamber containing a non-oxidizing protective atmosphere, whereupon a plugged hole in the alloying chamber is opened to allow the alloy to flow into a mold cavity also previously filled with a non-oxidizing atmosphere; consequently, the easily oxidized alloy is cast in the absence of atmospheric oxygen.

4 Claims, 5 Drawing Figures

FOUNDRY PRACTICES

This is a continuation, of application Ser. No. 230,614, filed Feb. 21, 1981, now abandoned.

This invention relates to casting metals alloyed with appreciable amounts of readily oxidized elements, such as aluminum, titanium, zirconium, and others. The inclusion of such elements in appreciable amounts may significantly enhance the properties of a casting, particularly heat resistant properties. It may also allow the reduction of the content of such critical elements as chromium in stainless steels or heat resistant alloys. But, when the percentage is to be, say more than one percent (by weight) it is necessary in many instances to cast in a vacuum to preclude an oxidizing atmosphere.

In the presence of oxygen, the easily oxidized element interferes with castability; it will form dross and non-metallic inclusions on the surface and trapped inside the casting which detract from the quality of the finished article and indeed may render it unacceptable as a casting likely to fail in service.

Vacuum casting is expensive and has a limit from the standpoint of casting size. If vacuum casting cannot be practiced, or if a facility is not available, then the advantage of the higher amount of the oxidizable element with regard to a number of properties of the alloy cannot be achieved.

Furthermore, when even fractions of a percent of such elements, for example, as Ti or Zr are added, the part of the alloying addition normally recovered in the casting is 70–40% of the amount added, sometimes even lower, so that excessive amounts are normally added to provide the desired residual. With the increasing cost of these materials, there is a substantial cost penalty. Additionally, difficulties in achieving the optimum content of these elements in alloys are encountered due to uncertainty in determining losses. Further, the residual content of these elements is frequently in the form of macroscopic oxide-type inclusions, in which form the element does not provide the desired improvement in properties.

One objet of the present invention is to enable appreciable amounts of a readily oxidizable element to be incorporated in a casting poured at ambient pressure under ordinary foundry conditions while effectively preventing the offending oxidizing atmosphere from contact with the pouring stream of metal and the metal inside the mold cavity. A specific object of the present invention is to enable levels of one-half percent aluminum and upwards to be incorporated in steel or superalloy casting without resorting to vacuum melting techniques to produce a sound, acceptable casting.

Another object of the invention is to achieve a high recovery percentage of the added elements in the final cast product.

Figure 1:
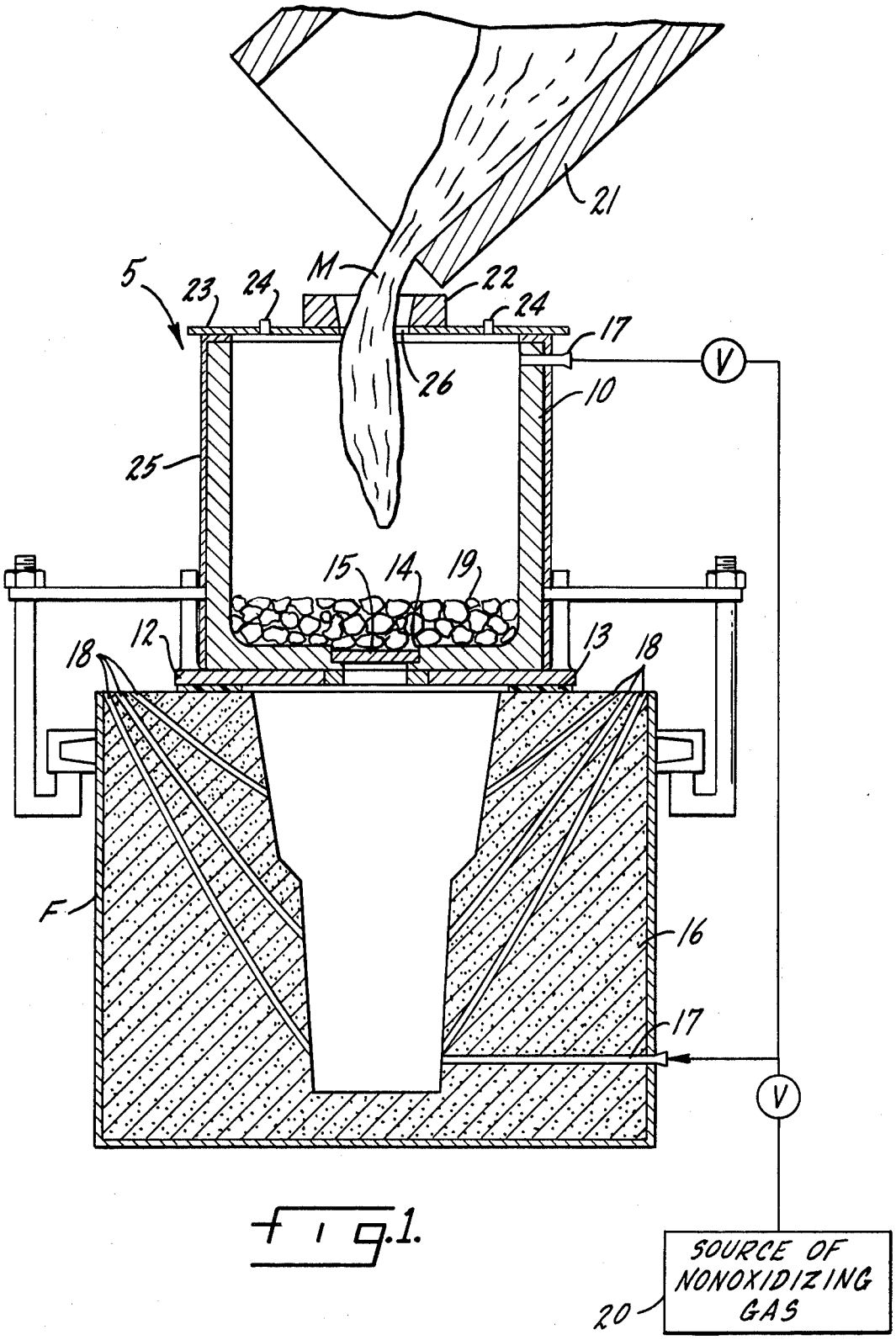
FIG. 1 is a sectional view of the casting apparatus constructed in accordance with the present invention at the first moment of pouring of the base alloy from a foundry ladle.

Referring to FIG. 1, the casting apparatus 5 of the present invention includes an alloying chamber 10 employed in the process.

The mixing of the base metal with a readily oxidizable alloying element takes place in the alloying chanber 10, FIG. 1. The cavity of the alloying chamber is isolated from the atmosphere using the cover 23, made of steel or ceramics. The gasket 25 is positioned between the top of the chamber and the cover 23 to effect a seal from the atmosphere. A pouring cup 22 is placed over the pouring opening 26. A non-oxidizing atmoshpere is supplied to the alloying chamber at a pressure greater than ambient from the source 20. The displaced air leaves the alloying chamber through the opening 26 and the vent passage 24.

A separable plate 12 is secured to the bottom of the chamber and the chamber has a bottom pour opening 14 closed by a meltable plug 15. A separable gasket seal is positioned between the open top of mold 16 (sand mold) and the steel plate. The alloying chamber and the steel plate are clamped to the mold, using an anchor lug or bracket on the side of the sand mold flask F, in the manner evident from FIG. 1.

The plug 15 is meltable at the pouring temperature of the molten metal M. A protective atmosphere (non-oxidizing or neutral) is supplied to the mold cavity at pressure greater than ambient from a source 20 connected to the inlet of a supply passage 16 in one wall of the mold and the displaced air is forced from the mold cavity through vent passages 18 formed in the mold walls. After an oxidizable metal 19 has been placed on the bottom of the alloying chamber and after the protective atmosphere has been supplied to the mold cavity and to the alloying chamber, the casting apparatus is ready for pouring the molten metal M to be alloyed with the readily oxidizable metal, FIG. 1.

Figure 2:
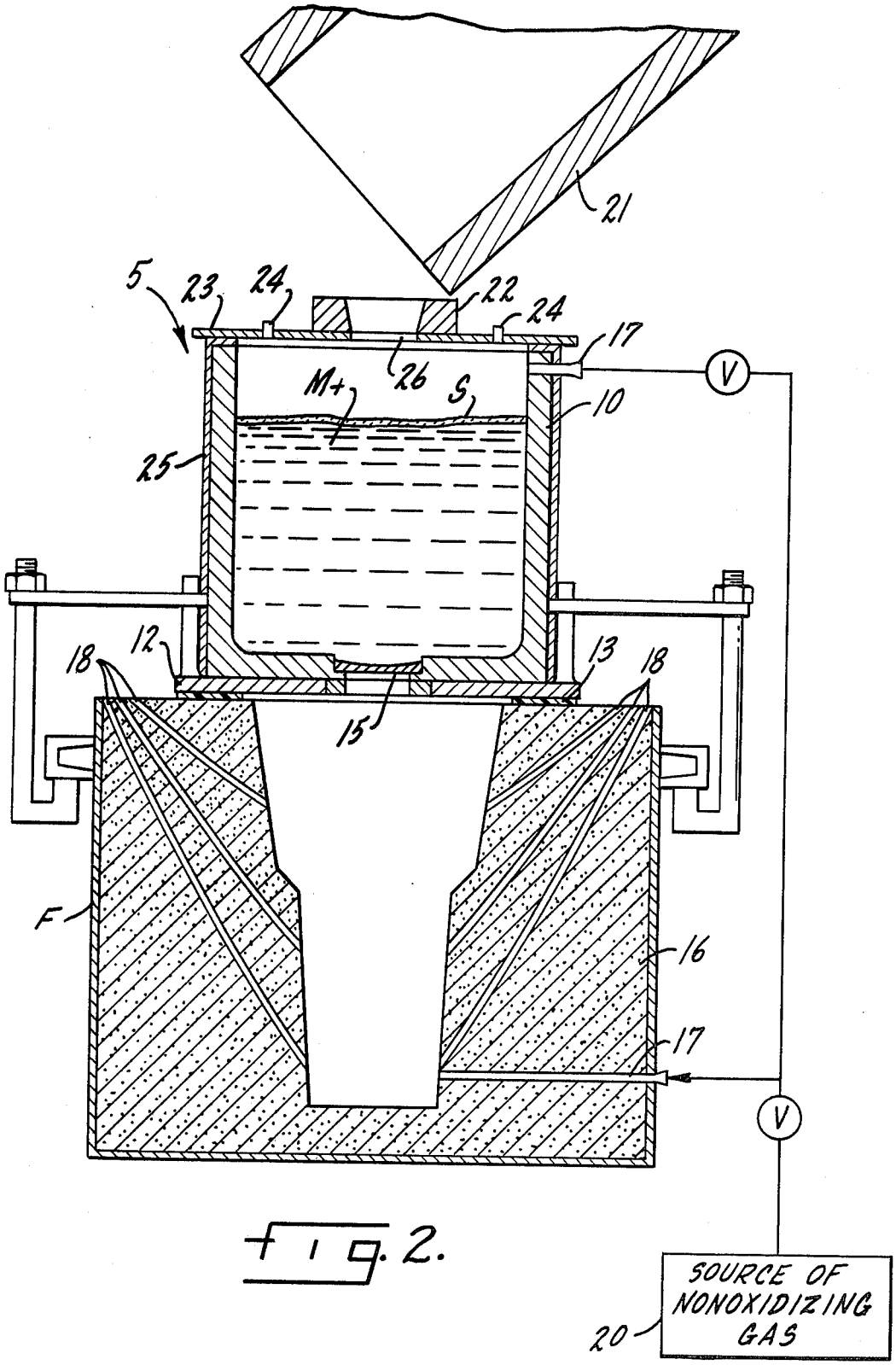
FIG. 2 is a view similar to FIG. 1, showing the state of the casting apparatus at the completion of pouring from the foundry ladle.
Figure 3:
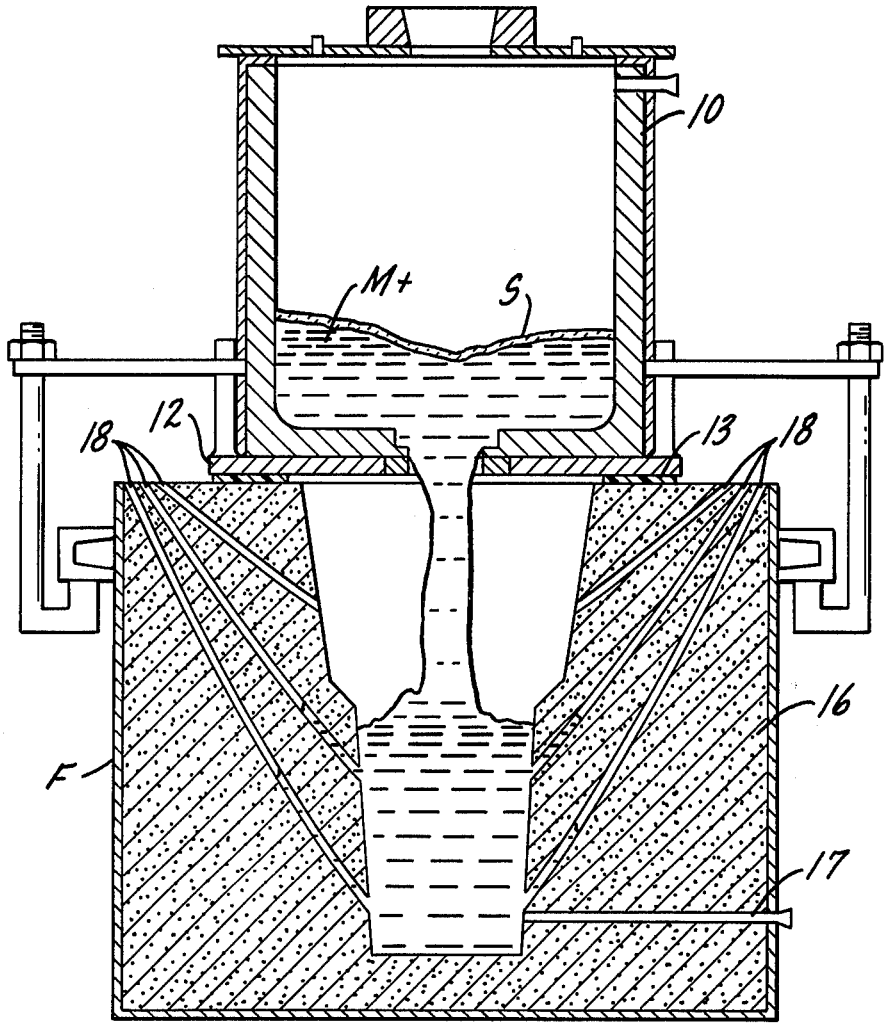
FIG. 3 is a view similar to FIG. 1 and 2, showing the casting apparatus during filling of the mold cavity.

When the base metal is poured from the ladle 21 through the pouring cup 22 into the alloying chamber, it melts the oxidizable metal which then alloys with the metal M forming an alloy M+. Turbulence, melting of the oxidizable alloying element, and rapid diffusion of the atoms of the alloying element in the molten base metal which is at relatively high temperature assures homogeneous distribution and alloying of the oxidizable element in the base alloy. The expanding protective gas leaves the alloying chamber through the passage 24. In the meantime, the plug has been temporarily holding the melt in the chamber (FIG. 2). Any incidental oxidation which might occur in the few seconds of mixing the solid addition element and the molten metal M will float as slag S (FIG. 2) to the top of the molten metal pool in the chamber and will, of course, be the last to flow out of the chamber becoming, at the worst, a dross in the downsprue, runner or riser to be separated from the casting. In time the plug itself melts (FIG. 3). As the first portion of the molten metal pours by gravity into the mold cavity through the mold opening, and as the temperature inside the mold cavity rapidly increases, the expanded protective atmosphere is displaced rapidly through the vent passages 18 (FIG. 3). This process is further accelerated by the incoming molten metal which eventually blocks the vent passages, as shown in FIG. 3.

Thus, until the last portions of the molten M+ leave the alloying chamber, there is no contact between the interior of the mold cavity and the ambient atmosphere in the foundry. Air can only enter the mold cavity after the molten metal has completely flowed from the alloying chamber and filled the mold cavity and is, therefore, harmless with respect to casting quality.

Castings produced in accordance with the present invention with aluminum as the oxidizable element exhibit a uniform distribution of aluminum in the casting. The castings exhibit exceptionally good surface appearance, characterized by a surface free of defect-causing oxides compared to castings of the same alloy but with only 2–3 percent aluminum cast in the ordinary fashion in which the foundrymen would anticipate drossy surfaces containing many oxide film folds and other oxide-related defects.

EXAMPLE

Using the apparatus and process herein described, a cast, heat-resistant alloy heat treating tray was produced as follows. 110 pounds of a base alloy A of the composition shown in Table I was prepared in an induction melting furnace using routine foundry practices. An oil-bonded silica sand mold was prepared by conventional molding practice, but equipped with vents according to this new process.

The apparatus described earlier was equipped with a meltable disc plug of 1020 steel, 0.27 inches thick and 3¼ inches in diameter. Six pounds of aluminum alloy #356 of the composition shown in Table I was separately melted, poured into the alloying chamber, and allowed to solidify in place on top of the steel plug. As can be seen, this weight of aluminum alloy comprises about 5.2% of the total metal to be cast into the mold cavity, and the contained aluminum represents approximately 4.8%.

The alloy chamber was covered as described earlier, and the apparatus was flushed with a volume of argon gas (ten times the volume of the mold cavity) to eliminate ambient air from both the alloying chamber and the mold cavity.

After this period of flushing of the alloy chamber and mold cavity, 110 lbs. of the base alloy A were tapped into a foundry lip-pour ladle and subsequently poured at a temperature of 2900° F. into the alloy chamber through the top pouring opening of the alloying chamber by means of the pouring cup.

Seven seconds after the end of the pour, the steel plug melted and the new, aluminum-containing composition poured into the oxygen-free mold cavity through the bottom pour opening of the alloying chamber.

The casting was allowed to solidify and, after cooling, was removed from the sand and cleaned according to conventional foundry practice. By subsequent analysis, the casting was found to contain 4.8% of aluminum, essentially 100% recovery of the aluminum added. Contrary to the expectation of those familiar with the effect of aluminum on casting quality, the surface of the cast tray with 4.8% aluminum was totally free of dross or "oxide fold" type defects and was judged, in fact, superior to a conventional casting free of all but the traces of aluminum conventionally used for deoxidation.

TABLE 1

| | Basic Composition of Alloys in Example | | | | | | |
|---|---|---|---|---|---|---|---|
| | C % | Cr % | Ni % | Fe % | Al % | Si % | Mg % |
| Alloy A | 0.40 | 10.0 | 20.0 | Bal. | — | — | — |
| 356 | — | — | — | — | 92 (min) | 7.0 | 0.3 |

As will be understood by those skilled in the art, the invention need not be restricted to the specific embodiment described. For example, the base alloys to be alloyed with the readily oxidized metal need not be restricted to ferrous metals, providing the oxidizable constituent can be provided at a melting point appropriate to the process.

Similarly, the preferred meltable plug may be replaced by a mechanically removable non-melting plug of metal, refractory, ceramic, graphite, or other material appropriate to the particulars of the process.

The protective atmosphere may be nitrogen or other nonoxidizing gas. The oxidizable element, such as aluminum, can be put into the bottom of the alloy chamber as a uniform layer of small, solid pieces (FIG. 1). Alternatively, aluminum may be separately melted, poured into the bottom of the alloying chamber, and allowed to solidify in place. Elements, such as titanium, which in themselves, have rather high melting points can be distributed in the bottom of the alloying chamber as prepared alloys selected for high content of the aforementioned element, together with a melting temperature appropriately lower than the melting temperature of the base alloy. Limitless alloy combinations of the readily oxidizable elements can be achieved by preparing particulate or powder metal compacts to be distributed in the bottom of the alloying chamber.

Examples of useful alloys for achieving a reduction in the melting point of titanium, for example, are the eutectic alloys 72%Ti–28%Ni and 68%Ti–32%Fe with melting points of 943° C. and 1086° C. respectively; far below the typical liquidus temperature of, for example, an iron base, 25%Cr, 20%Ni, 0.40%C, base alloy to be alloyed with titanium, i.e. approximately 1400° C.

The oil-bonded silica sand mold cavity may be replaced by molds manufactured by any of a large number of common mold-forming processes and materials, as well as by properly vented permanent molds. The invention equally applies to the production of centrifugally cast articles where permanent molds are used.

Figure 4:
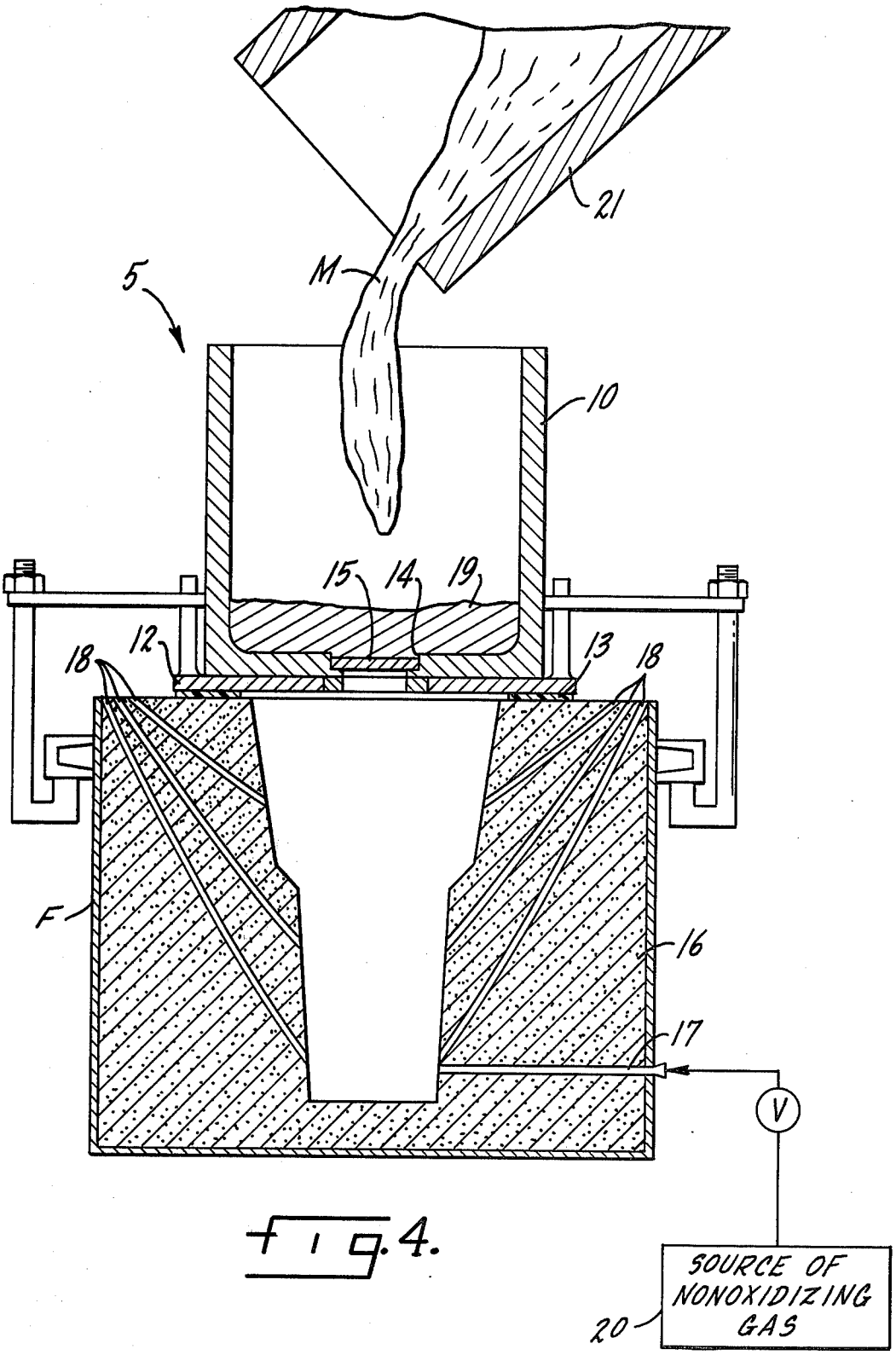
FIG. 4 is a view of a simplified casting apparatus wherein a protective atmosphere is applied only to the mold cavity.

In some cases, when the amount of the addition of an oxidizable element is not high or when the amount of nonmetallic inclusions in a casting is not critical to its performance, successful results can be achieved without applying the protective atmosphere into the alloying chamber. The modification of the casting apparatus in these cases is shown in FIG. 4.

Figure 5:
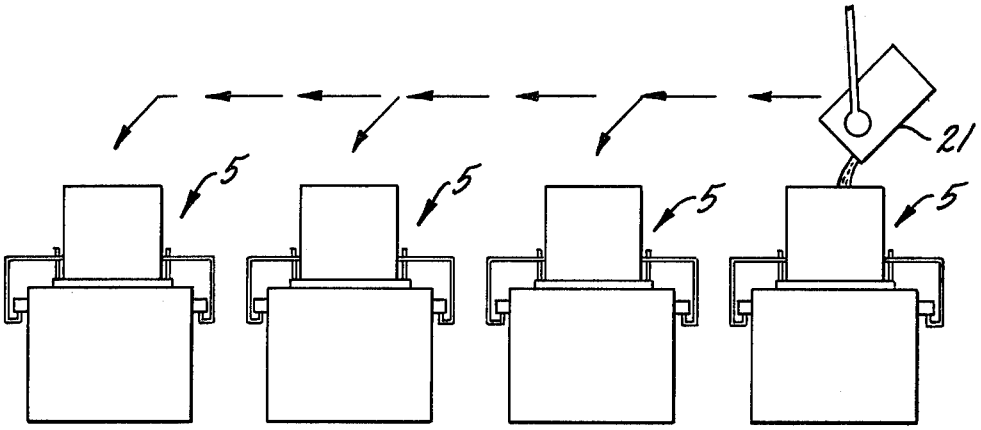
FIG. 5 is a schematic view showing a multiple casting apparatus employed under the present invention.

If several molds are poured from a single ladle by conventional foundry procedure, the oxidizable element is added into the ladle and the concentration of the oxidizable element decreases from casting to casting, and the excessive slag formation causes serious problems. Though castings made according to this invention contain readily oxidizable elements, metal being melted, tapped into the ladle and held in the ladle does not contain any readily oxidizable elements, other than very low amounts used for conventional deoxidation. Therefore, many molds can be poured from a single pouring or holding ladle, FIG. 5, without danger of losing readily oxidizable elements into the ladle slag during the time required to pour several molds.

We claim:

1. A method of casting an alloy combining one or more readily oxidizable metals while precluding atmospheric oxygen when casting and wherein alloying of the base alloy with the oxidizable metal takes place in an alloying chamber moments before castings, comprising:

(a) providing a mold with a casting cavity having means for venting for the escape of air contained therein and communicating with a supply passage through which a non-oxidizing gas may be admitted to the mold cavity;

(b) positioning an alloying chamber adjacent to the mold cavity, the alloying chamber having a pouring opening in its bottom communicating with the mold cavity, isolating the alloying chamber from the atmosphere with a removable cover having vent passages for the escape of air and having a pouring opening at its top;

(c) closing the bottom pour opening of the alloying chamber with a plug to isolate the pouring chamber from the mold cavity and disposing in the pouring chamber an unmelted oxidizable metal;

(d) admitting the non-oxidizing gas to the mold cavity and to the pouring chamber in an amount to displace air therein and, after the air has been so displaced, pouring a body of molten metal from a ladle through the pouring opening at the top of the alloying chamber to impinge atop the oxidizable metal in the alloying chamber, the poured body of metal having a melting point higher than that of the oxidizable metal thereby quickly melting the oxidizable metal and creating the casting alloy in the alloying chamber; and (e) disclosing the bottom pour opening shortly after the oxidizable metal has been alloyed with the molten metal poured into the alloying chamber whereupon the alloyed metal flows into the casting cavity, thereby displacing the protective atmosphere through the vent passage while concurrently preventing the intrusion of air into the casting cavity.

2. A method according to claim 1 in which the plug is meltable by the molten metal.

3. A method according to claim 1 in which the readily oxidizable metal is first melted and poured in the alloying chamber atop the plug to solidify therein before the molten metal is poured.

4. The method of pouring several molds sequentially in a series with an alloy containing an easily oxidizable metal, in which a metal to be alloyed therewith is contained in a holding or pouring ladle and employing the casting method of claim 1 for pouring of each mold by tipping the ladle to charge the respective alloying chambers with portions of the metal poured therefrom.

* * * * *